United States Patent [19]

Sasaki et al.

[11] 3,934,346

[45] Jan. 27, 1976

[54] SPORTING SHOES

[76] Inventors: Kyozo Sasaki, No. 4-8, Rokuro kuso-cho; Minoru Murayama, No. 18-203, 8-chome, Saido-cho, both of Ashiya, Hyogo, Japan

[22] Filed: Dec. 12, 1974

[21] Appl. No.: 531,853

[52] U.S. Cl. ..... 36/2.5 R; 36/50

[51] Int. Cl.[2] ..... A43B 11/00

[58] Field of Search ..... 36/2.5 R, 50

[56] References Cited

UNITED STATES PATENTS

| | | | |
|---|---|---|---|
| 453,475 | 6/1891 | Harding | 36/2.5 R |
| 3,427,020 | 2/1969 | Montour et al. | 36/2.5 R |
| 3,546,796 | 12/1970 | Adams | 36/2.5 R |

*Primary Examiner*—Patrick D. Lawson

*Attorney, Agent, or Firm*—George B. Oujevolk

[57] ABSTRACT

A shoe of the sneaker type. This sneaker is provided with a shoelace or shoe string having branch strings or with a plural number of strings so that said string or strings may be tightened across the instep at a plural number of spots on the shoe. By this, the shoe can be tightened for fitting by the wearer without taking the trouble of adjusting the string as in the case of conventional sneakers.

3 Claims, 5 Drawing Figures

SPORTING SHOES

This invention relates to a sneaker-type shoe and in particular to a sneaker-type shoe wherein one or more shoe strings or shoelaces are provided thereon so as to be tied at a plural number of spots at the instep.

As is well known, the shoelace or shoe string of a shoe in use is tied at both ends at the rear terminal of the instep so as to make the string tightened across the instep, the string being inserted through a score of parallel holes in such a manner that one half portion of the string crosses the other half portion between one hole and the other hole on opposite sides. And to tighten the string in this manner it is usually necessary to haul in the string at both sides of the instep so as not to leave the string partially loosened at the instep intermediately from the front to the rear of the shoelace.

A main object of this invention is to provide a shoe especially for sporting use where it is possible to tie a shoelace or strings at more than one spot so that the shoe may be worn in a fitting state without taking the trouble of hauling in the string.

In order that this invention may be readily understood, reference is made hereinunder to the annexed drawing which illustrate, by way of examples, preferred embodiments of this invention.

Figure 1:
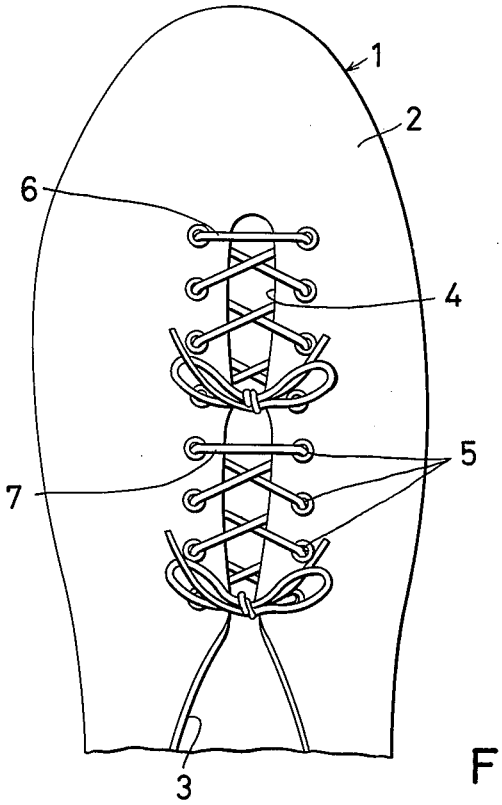
FIG. 1 is a plan view showing main parts of a sneaker provided with shoelaces or strings of this invention in the first embodiment.
Figure 3:
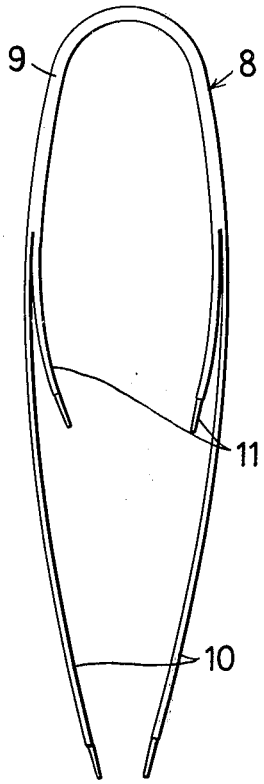
FIG. 3 is a plan view of a string used in the second embodiment.

In the first embodiment shown in FIG. 1, numeral 1 designates a sneaker proper wherein an instep, a foot-putting-in portion and an opening are designated by numerals 2, 3 and 4, respectively.

On the instep at both sides of said opening 4 are formed a plural number of string-inserting holes 5 in two rows, said holes 5 numbering 8 in total in case of this FIG. 1.

Two shoelaces or strings 6 and 7 of equal length, are inserted through said holes 5, the former occupying the front four holes and the latter the rear four holes thereby being tied in a bow at both ends at respective spots, the former in the middle along the opening 4 and the latter at the rearmost position as seen clearly in the drawing. The strings are inserted through said holes so that one half of a string crosses the other thereby stretching slantways between one hole and the other hole at the rear along the opening 4, this manner being nothing but that of conventional sneakers.

In the second embodiment, the opening 4 is tightened at two spots, one being the middle portion and the other the end portion thereof, with a single string 8, said string 8 comprising a base portion 9, a pair of longer branches 10 and another pair of shorter branches 11, both 10 and 11 branching out from said base portion 9 at both terminal portion thereof as will be clearly seen in the drawing.

Figure 2:
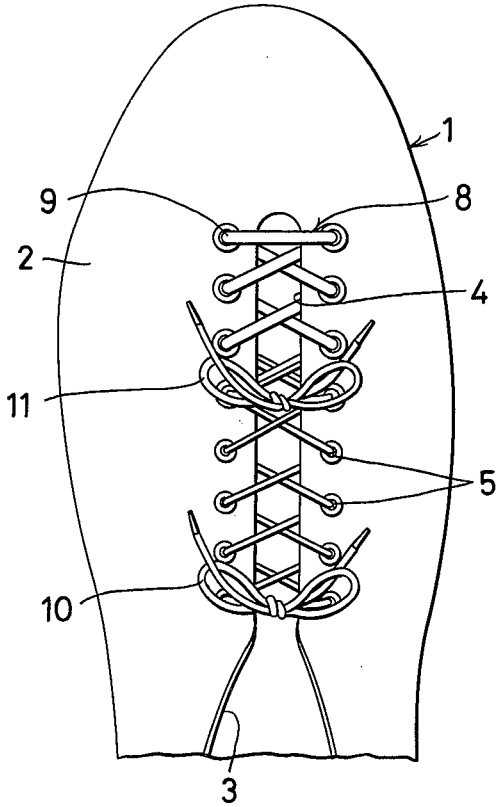
FIG. 2 is a plan view of a string-provided sneaker in the second embodiment.

In this embodiment, the shorter branches 11 are tied at both ends at a spot in the middle along the opening 4 and the longer branches 10 at the rear therealong, as shown in FIG. 2.

Figure 5:
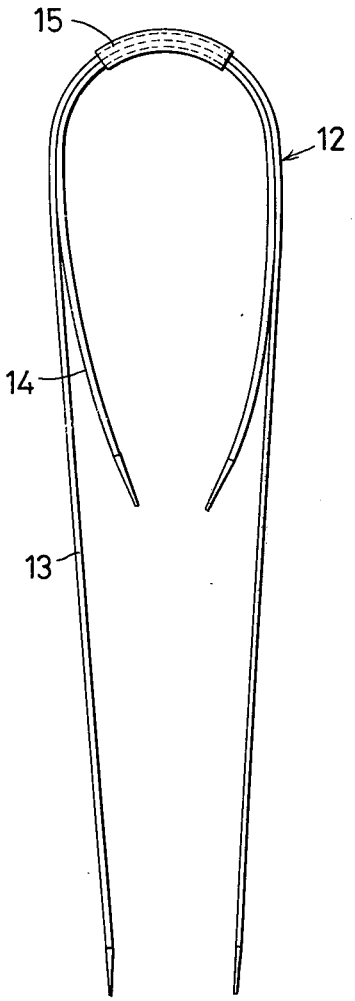
FIG. 5 is a plan view of a string used in the third embodiment.
Figure 4:
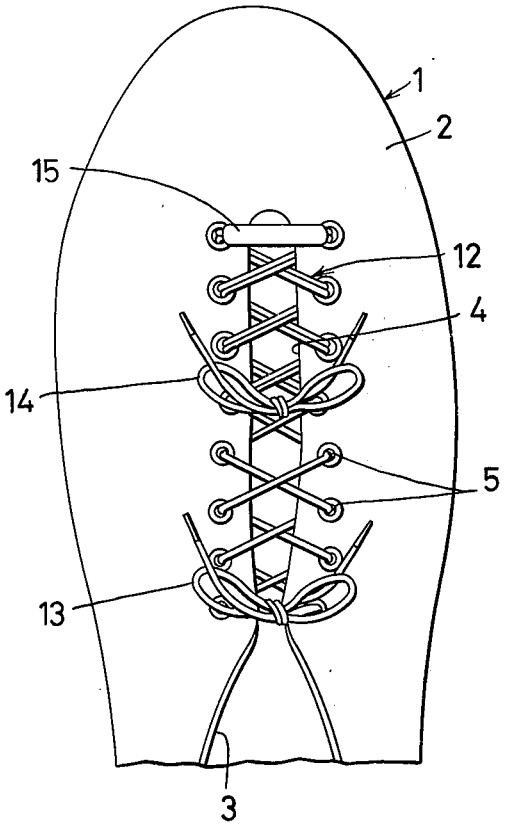
FIG. 4 is a plan view of a string-provided sneaker in the third embodiment.

In the third embodiment illustrated in FIG. 4 and 5, a string proper 12 comprises two parallel strings varying in length, the longer string being designated by numeral 13 and the shorter one numeral 14, said strings 13 and 14 combining in mutual contact through a flexible tube 15 provided at the middle portion of said strings.

Shorter string 14 is tied at both ends thereof at the middle portion along the instep opening 4 also, the longer string 13 is tied at the rear.

In this embodiment, the tube 15 is so designed as to be exchangeable with a new one at needs. Also, instead of applying tube 15 to this embodiment, the strings might be connected by means of a braid at the middle portion.

What is claimed is:

1. A shoe, including an instep with a plural number of elongated shoe strings, said strings having a middle section and being so arranged as to be tightened across said instep at a plurality of locations, and, fastening means at said middle portion combining said strings in parallel.

2. A shoe as claimed in claim 1 wherein said fastening means is a flexible tube.

3. A shoe provided with a shoe string having minor strings branching out intermediately from said string, said branch strings being so arranged as to be tightened across the instep at respective spots in front of tightening spot of the string proper.

* * * * *